US006472628B2

(12) United States Patent
Nauche et al.

(10) Patent No.: US 6,472,628 B2
(45) Date of Patent: Oct. 29, 2002

(54) CIRCUIT-BREAKER INCLUDING A MOVING ASSEMBLY CONTAINED INSIDE A CASING FILLED WITH A DIELECTRIC GAS UNDER PRESSURE

(75) Inventors: Michel Nauche, Pierre Benite; Bruno Luscan, Lyons, both of (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/846,220

(22) Filed: May 2, 2001

(65) Prior Publication Data

US 2002/0000425 A1 Jan. 3, 2002

(30) Foreign Application Priority Data

May 3, 2000 (FR) ..... 00 05662

(51) Int. Cl.[7] ..... H01H 33/18

(52) U.S. Cl. ..... 218/43; 218/59; 218/60; 218/64

(58) Field of Search ..... 218/43, 45, 48, 218/51, 53, 59–64, 72–73, 78, 154

(56) References Cited

U.S. PATENT DOCUMENTS 4,514,605 A * 4/1985 Pham Van ..... 218/154
4,650,941 A * 3/1987 Thuries et al. ..... 218/154
6,078,485 A * 6/2000 Perdoncin ..... 218/59

FOREIGN PATENT DOCUMENTS

EP 0 807 946 11/1997 ..... H01H/33/90
FR 2 752 478 2/1998 ..... H01H/33/915

OTHER PUBLICATIONS

European Search Report dated Jan. 10, 2001.

* cited by examiner

*Primary Examiner*—Lincoln Donovan
(74) *Attorney, Agent, or Firm*—Sughrue Mion, PLLC

(57) ABSTRACT

A circuit-breaker including a first tube, and a second tube coaxial to the first tube, the first and second tubes being connected together via a piston provided with perforations and equipped with a valve member, the first tube having an end connecting to said piston, a moving arcing contact support being fixed rigidly to said piston on the other side from the first tube, wherein, with said piston having a bore of diameter D, said piston is provided with a groove, that end of said first tube which is connected to said piston being provided with n gaps allowing n claws to project, the end of at least one of the claws being provided with a rim that is received in said groove in said piston, said piston being provided with one or more passageways angularly in register with each claw provided with a rim, and making it possible for the rim(s) to be inserted axially as far as said groove, and then for the tube to be turned to cause the rim to penetrate into the groove portions that remain, and wherein said arcing contact support is provided with n gaps and with n claws that are complementary to the gaps and claws of said first tube, the claws of said arcing contact support fitting into and filing the gaps situated between the claws on said first tube.

6 Claims, 9 Drawing Sheets

CIRCUIT-BREAKER INCLUDING A MOVING ASSEMBLY CONTAINED INSIDE A CASING FILLED WITH A DIELECTRIC GAS UNDER PRESSURE

FIELD OF THE INVENTION

The present invention relates to a circuit-breaker including a moving assembly contained inside a casing filled with a dielectric gas under pressure, the moving assembly including a "drive" first tube, and a second tube surrounding the first tube coaxially, said first and second tubes being connected together via a ring provided with perforations and equipped with a valve member and constituting a moving piston separating a compression chamber from a blast chamber, said first tube being situated on the same side of the ring as the compression chamber and its end connecting to said ring, a moving arcing contact support being situated on the same side of the ring as the blast chamber and being fixed rigidly, with no degrees of freedom, to said ring.

More particularly, the invention relates to a high-voltage circuit-breaker and to the mode of assembling the ring or piston firstly with the drive tube and secondly with an arcing contact support that is part of the moving assembly.

BACKGROUND OF THE INVENTION

Currently, the drive tube is screwed into the ring with tightening torque being applied. The resulting coupling is then locked either by adhesive or by a locking screw, or else by deforming the material. The arcing contact support is fixed in the same way.

That type of coupling is unsatisfactory since it is difficult to assemble, requiring a large tightening torque, thereby deforming the long parts, in particular the drive tube.

It is difficult to lock the coupling: when adhesive is used, it is necessary to prepare the surfaces, the adhesive can run, and it is necessary to use a adhesive that withstands high temperatures.

If a locking screw is used as the locking means, such a screw requires a certain installation thickness.

Locking by means of deforming the material manually is not always repeatable.

If the parts are made of aluminum, it is impossible to assemble them together by means of screw threads because of seizing, and it is then necessary to perform surface treatment on one of the parts to be assembled together, which then requires further machining on the bearing surfaces in order to enable electricity to flow through.

In addition, in such known screw coupling, a groove is machined in the arcing contact support or else in the ring (piston) for the purpose of receiving a valve member. Such machining requires good accessibility, or else cutting out to be performed specially on the parts, and this excludes the use of valve members made of metal since the valve member must be stretched elastically while being fitted in order for it to be placed in the groove.

OBJECTS AND SUMMARY OF THE INVENTION

An object of the present invention is to provide a non-screw mode of coupling in order to eliminate the above-mentioned drawbacks.

The invention thus provides a circuit-breaker as defined above, wherein, with said ring having a bore of diameter D, said ring is provided with a groove of depth h and of width l at a distance x from its face that faces said compression chamber, that end of said first tube which is connected to said ring being provided with n gaps extending over an axial length L allowing n claws to project, the end of at least one of the claws being provided with a rim that is received in said groove in said ring, said ring being provided with one or more passageways angularly in register with each claw provided with a rim, and making it possible for the rim(s) to be inserted axially as far as said groove, and then for the tube to be turned to cause the rim(s) to penetrate into the groove portions that remain, and wherein said arcing contact support, which is tubular, is provided with n gaps and with n claws that are complementary to the gaps and claws of said first tube, the claws of said arcing contact support fitting into and filing the gaps situated between the claws on said first tube.

Another characteristic of the invention makes it equally possible to use a flexible valve member or a metal valve member. According to this characteristic, at a distance $l_1$ from the end-walls of the gaps, said arcing contact support is provided with a flange of outside diameter $D_l$ and that comes into abutment against said ring, means being provided for constituting a groove for receiving a valve member against that face of said ring which faces the blast chamber.

In a first embodiment of the invention, said rigid fixing whereby said arcing contact support is fixed rigidly to said ring is achieved by forcing the end of length $l_1$ extending from said flange to the end walls of said gaps to penetrate into the bore of diameter D in said ring, the outside diameter of the claws being such that they penetrate into said bore freely, said means for constituting said groove for receiving a valve member comprising a bearing surface belonging to said ring, of inside diameter D and of outside diameter $D_2$ such that $D_1>D_2>D$, and against which said flange bears.

In a second embodiment, said rigid fixing whereby said arcing contact support is fixed rigidly to said ring is achieved by fixing said flange by means of screws against that face of said ring which faces the blast chamber, the peripheral portion of that side of said flange which bears against said face being provided with a bearing surface for receiving said valve member, and thus forming said groove.

BRIEF DESCRIPTION OF THE DRAWINGS

An embodiment of the invention is described below with reference to the accompanying drawings, in which.

MORE DETAILED DESCRIPTION

Figure 1:
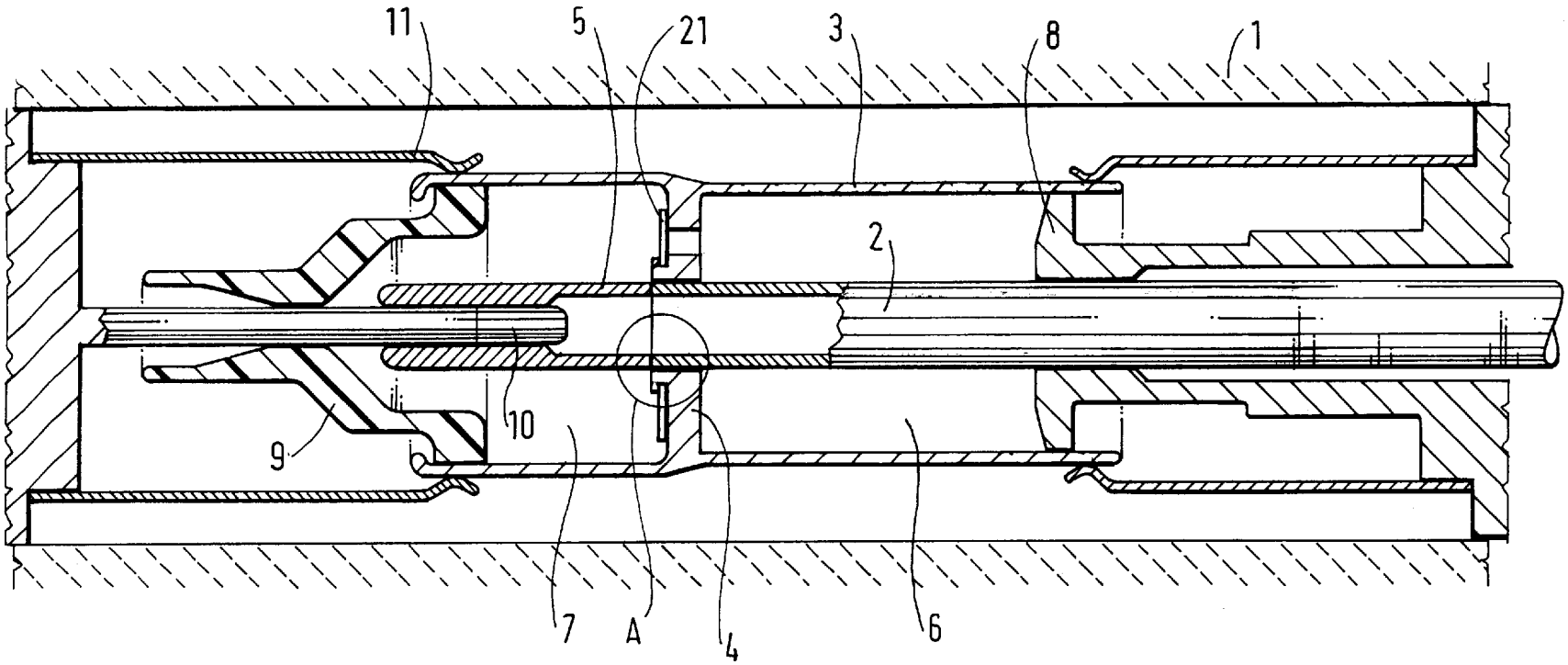
FIG. 1 is a fragmentary diagrammatic view of a circuit-breaker, serving to locate the innovation of the invention.

FIG. 1 is a fragmentary view of a high-voltage circuit-breaker including an insulating casing 1 filled with a dielectric gas, such as $SF_6$ for example, under pressure.

The casing 1 contains the members of the circuit-breaker and, in particular, it contains a moving assembly. The moving assembly includes, inter alia, a "drive" first tube 2, a second tube 3 surrounding the first tube coaxially, a ring 4 constituting a moving piston, and an arcing contact support 5. To simplify the figure, the arcing contact support and the arcing contacts are shown diagrammatically as a single piece. The ring 4 connects the drive tube 2 to the second tube 3.

The invention relates to how the three parts: drive tube 2, arcing contact support 5, and ring or piston 4 are assembled together. The other figures (FIGS. 2 to 10) show these parts, either as assembled or separately and generally in fragmentary manner, in the zone referenced A in FIG. 1.

The ring 4 separates a compression chamber 6 from a blast chamber 7.

The compression chamber 6 is provided with an end-wall 8 constituting a piston that is fixed, but that could, as in some circuit-breakers, be "semi-moving". The ring 4 is provided with perforations and, on the side facing the blast chamber 7, it is provided with a valve member 21.

At its end, the second tube 3 is provided with a blast nozzle 9.

FIG. 1 also shows a fixed arcing contact 10 and fixed permanent contacts 11. Naturally, the invention also applies to circuit-breakers in which these contacts are also moving contacts, as in circuit-breakers having double contact movement.

The invention is explained in more detail below by describing the parts situated in the zone reference A in FIG. 1, with reference to FIGS. 2 to 10.

Figure 2:
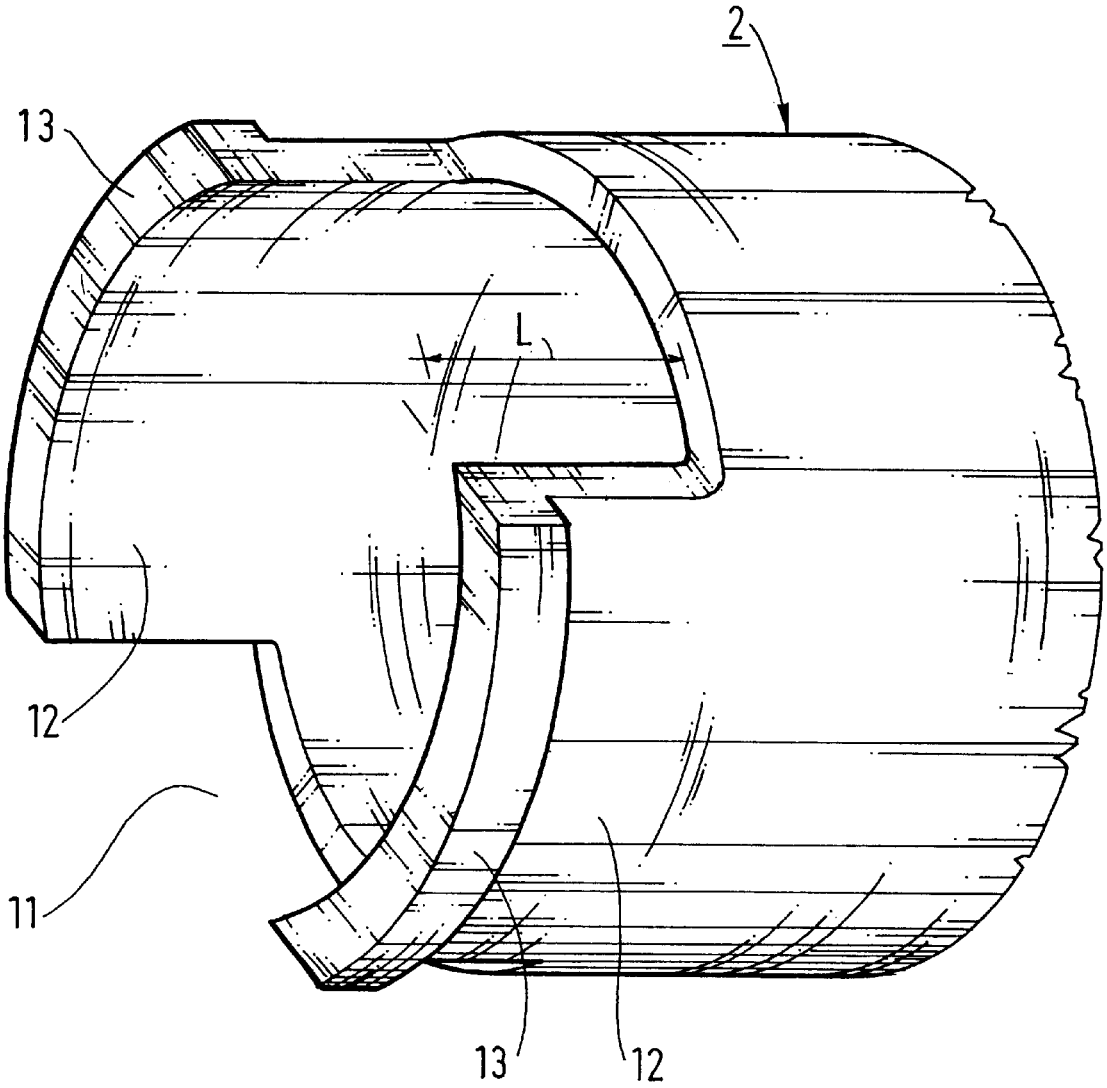
FIG. 2 is a perspective view of the end of the drive tube that connects to the ring, or piston, of a circuit-breaker of the invention.

FIG. 2 shows the end of the drive tube 2 that connects to the ring 4.

As shown in the figure, the end of said tube is provided with n gaps 11 leaving n claws 12 to project. In the example shown, n=2, and there are therefore two claws 12 and two gaps 11. The axial length of the claws 12, corresponding to the axial length of the gaps is referenced L in FIG. 2. The end of at least one of the n claws 12 is provided with a rim 13, and although not absolutely essential, each of the claws is provided with such a rim in the example described.

Figure 5:
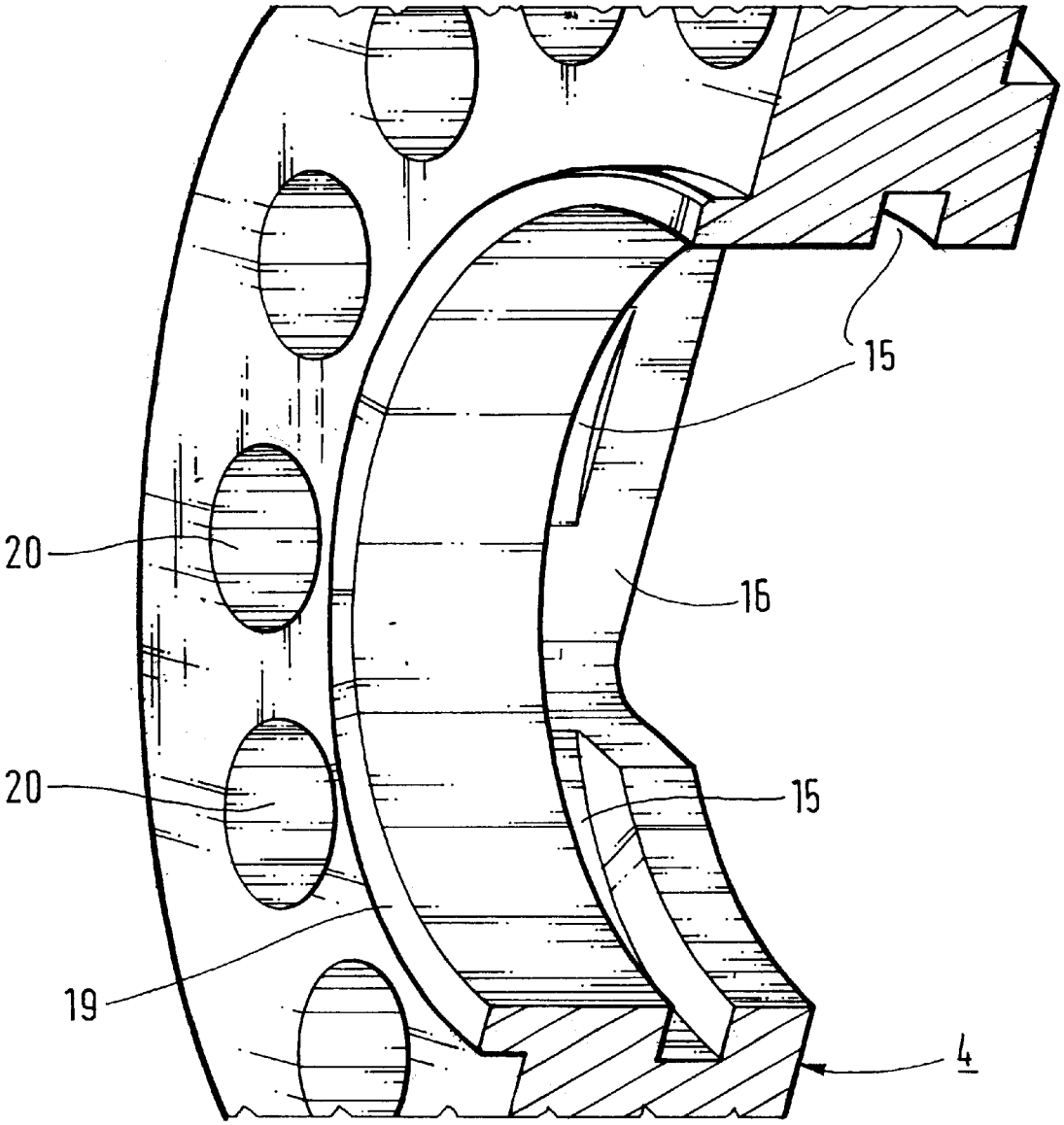
FIG. 5 is a fragmentary perspective view of a ring of a circuit-breaker of the invention.
Figure 6:
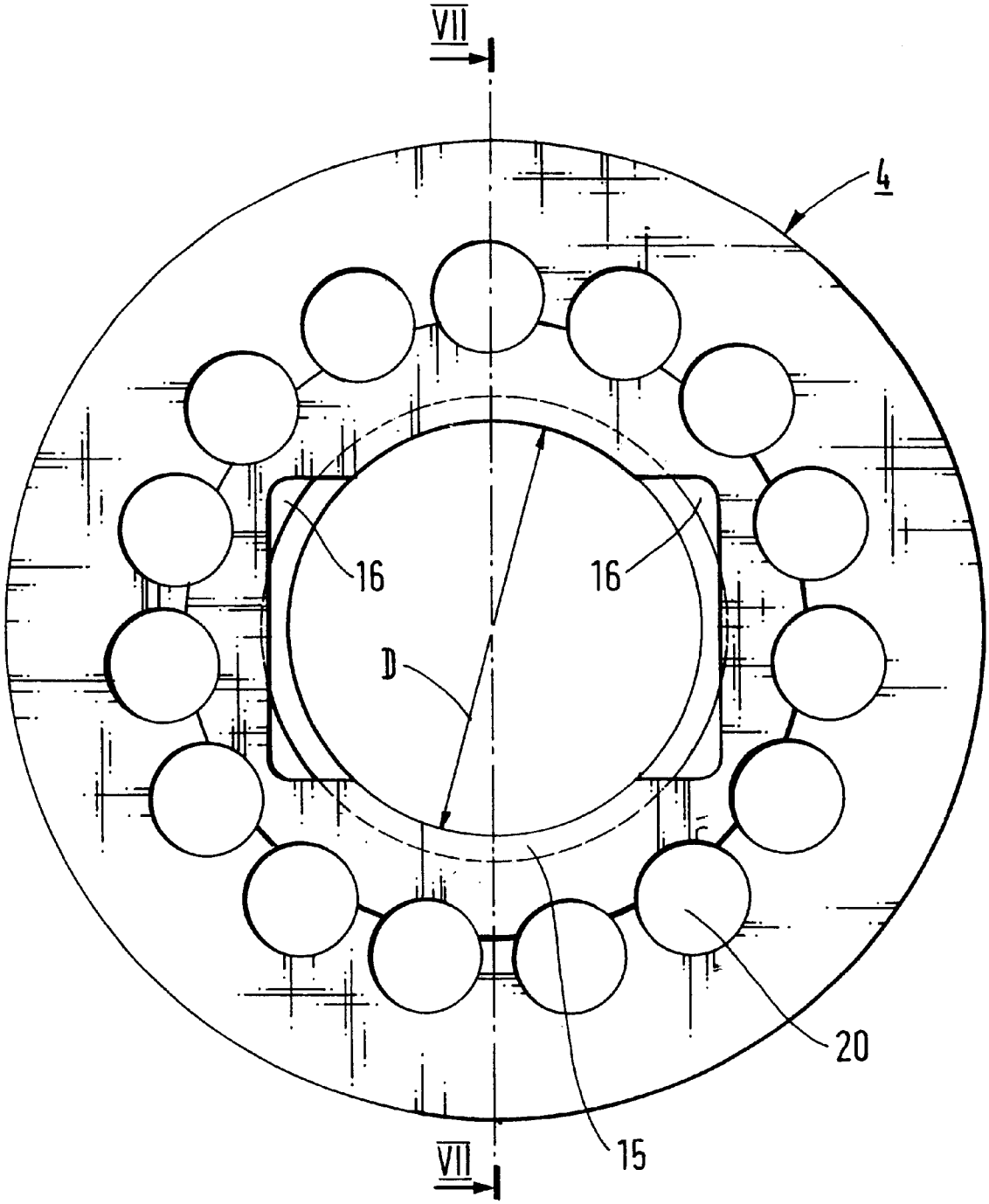
FIG. 6 is a plan view of the ring of FIG. 5.
Figure 7:
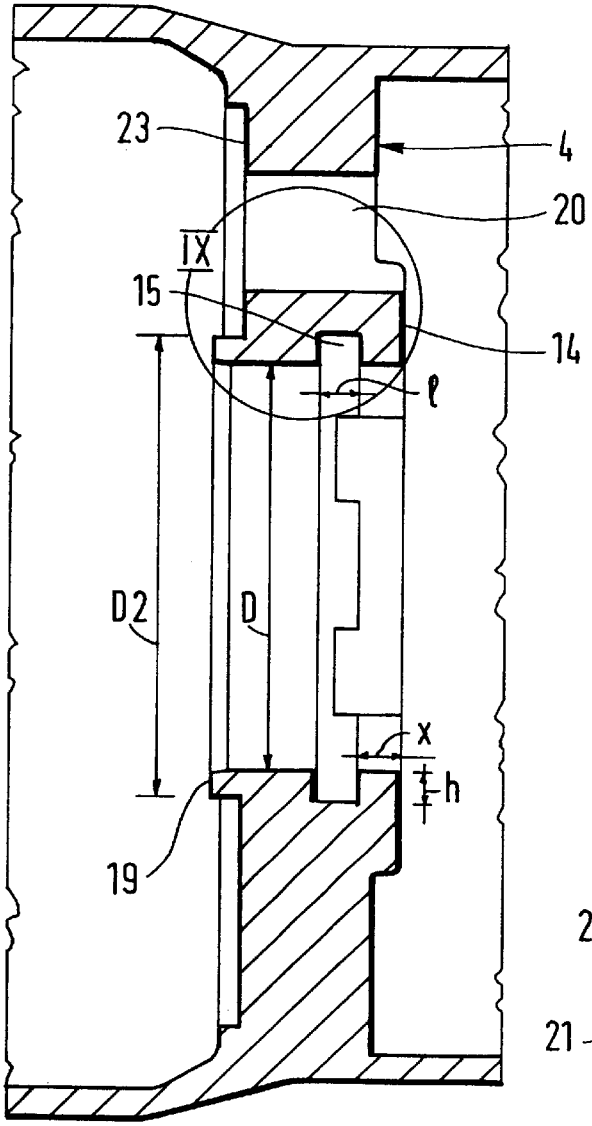
FIG. 7 is a fragmentary section view on VII—VII of FIG. 6.

FIGS. 5, 6, and 7, which are respectively a fragmentary perspective view and two plane views, show the ring or piston 4, and, with reference to these figures, a description follows of the features of the ring that make it possible to connect it to the end of the above-described tube 2.

The ring is provided with a bore of diameter D equal to the outside diameter of the drive tube 2, ignoring the clearance necessary for the tube to be inserted and to be turned.

At a distance x from the face 14 situated facing the compression chamber 6 (FIG. 1), the ring is provided with a groove 15 of depth h and of width l.

The depth h of the groove 15 must be such that the rim 13 on the drive tube 2 can be inserted into said groove without difficulty. In practice, as can be seen in the perspective view in FIG. 8 which shows all of the parts as assembled together, the rim 13 is of a height slightly smaller than the depth of the groove 15 in the ring 4. In addition, the ring 4 is provided with two passageways 16 angularly in register with the rim 13 of each claw 12 so as to enable the tube 2 to be inserted axially into the ring 4 by disposing the rims 13 in the passageways 16. The rims can thus pass along the passageways as far as the groove 16, and the tube is then turned so as to cause the rims 13 to penetrate into the remaining portions of the groove 15.

Naturally, if there are n claws but all of the claws do not carry rims, the number of passageways 16 corresponds to the number of claws that do have rims.

As can be seen clearly in FIGS. 6 and 7, the passageways 16 are formed by milled recesses whose axial depth exceeds the distance x, but this is not essential.

Penetration corresponding to the length x suffices. Moreover, it can be observed that the depth of the recess is slightly shallower than the depth h of the groove 15, which poses no problems since the height of the rim 13 is smaller than the depth h of said groove.

Naturally, this is merely one embodiment, but what is necessary and sufficient is that the rims can pass freely and that the tube can then be turned so that the rims are received in the remaining portions of the groove 15. The tube 2 is thus secured axially to the ring 4, leaving only the clearance that is necessary for assembly purposes. Ignoring clearance, the drive tube 2 is prevented from rotating by the claws 12 co-operating with complementary claws on the end of the arcing contact support 5, which is described below with reference to FIGS. 3 and 4, and which is fixed rigidly to the ring 4 with no degree of freedom and with no clearance. Thus, by penetrating into the gaps 11 in the end of the drive tube 2 and filling them (ignoring clearance) the claws of the arcing contact support 5 prevent the tube from turning and thus prevent the rims 13 from exiting from the remaining portions of groove 15. The drive tube is thus prevented from moving both axially and also in rotation, ignoring clearance.

Figure 3:
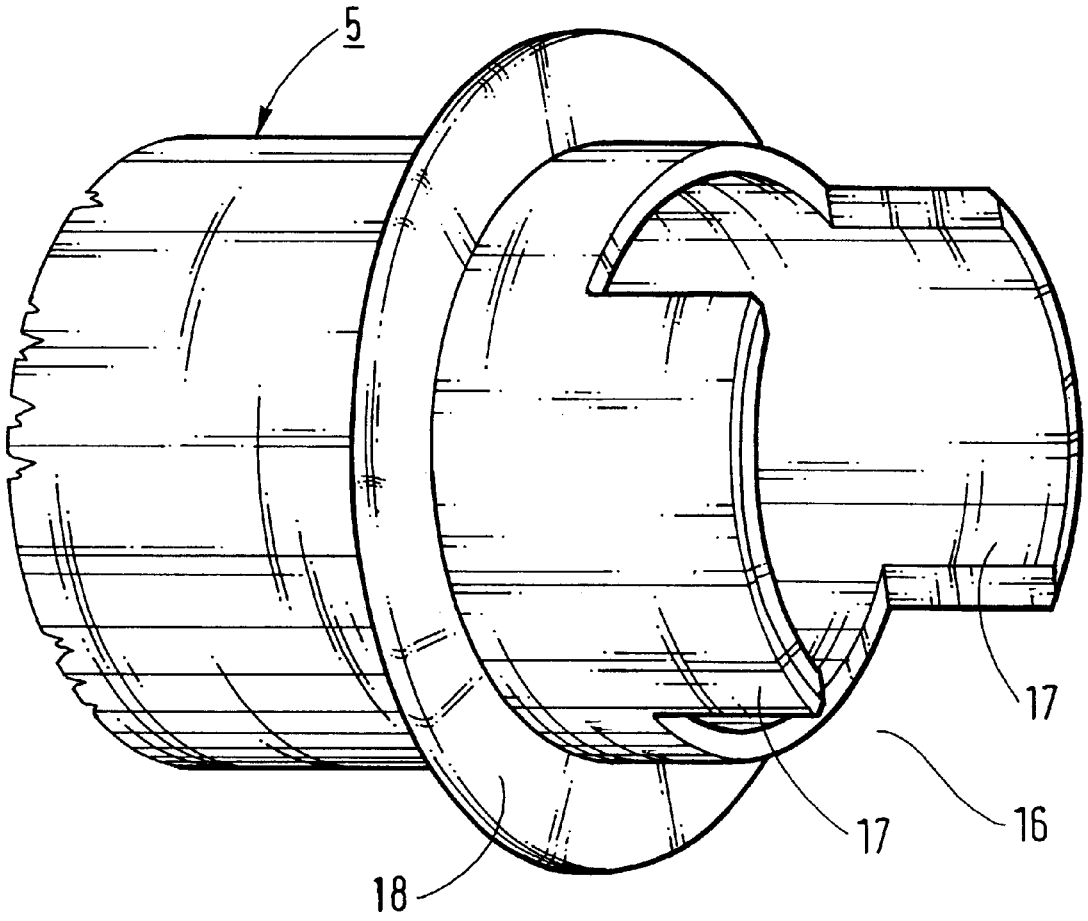
FIG. 3 is a perspective view of the end of the arcing contact support that fixes rigidly to the ring of a circuit-breaker of the invention.
Figure 4:
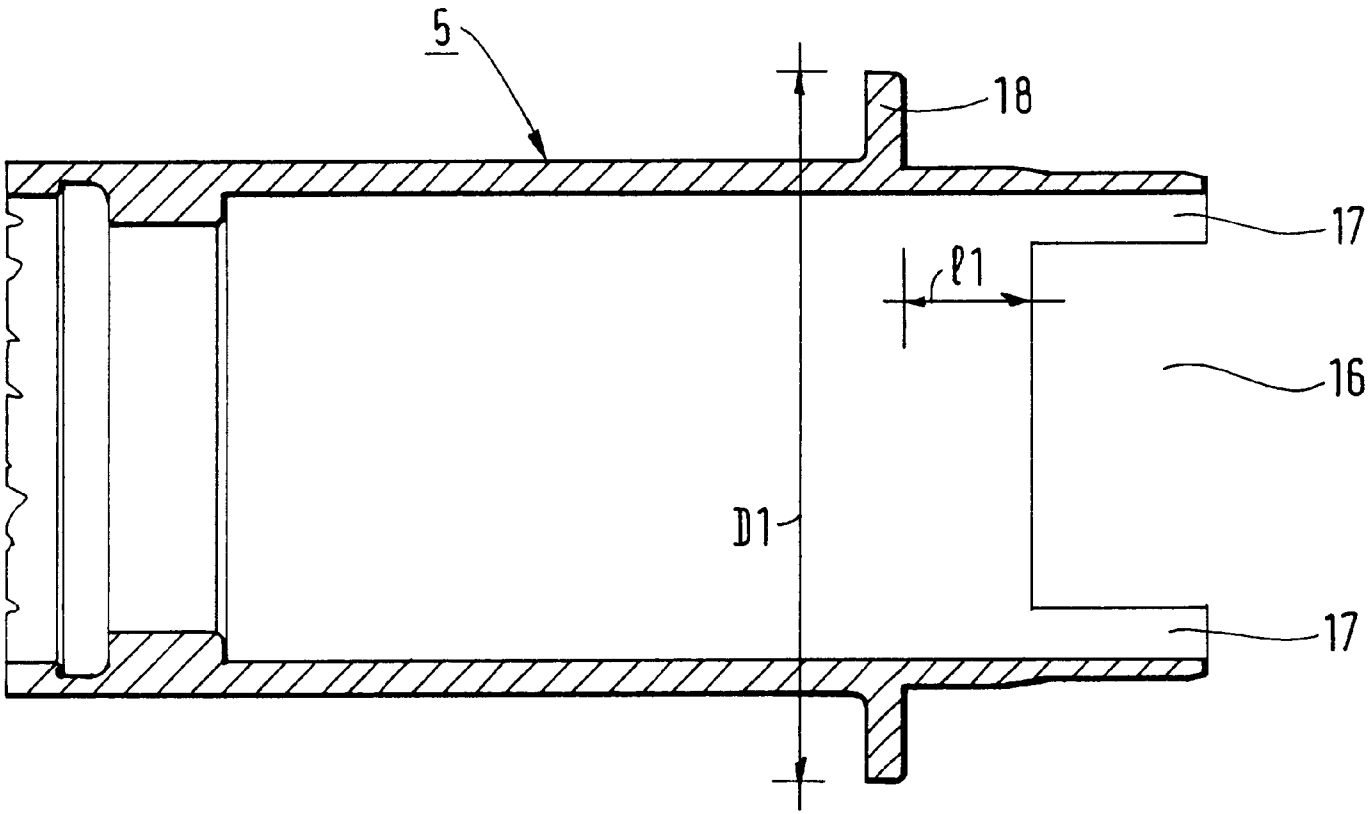
FIG. 4 is a section view through the end of the arcing contact support in a circuit-breaker of the invention, on an axial plane passing through the middle of a claw (the arcing contact support having two claws in the example described)

FIGS. 3 and 4 thus show the end of the arcing contact support 5 respectively in perspective and in section on an axial plane passing through the middles of the claws.

Figure 8:
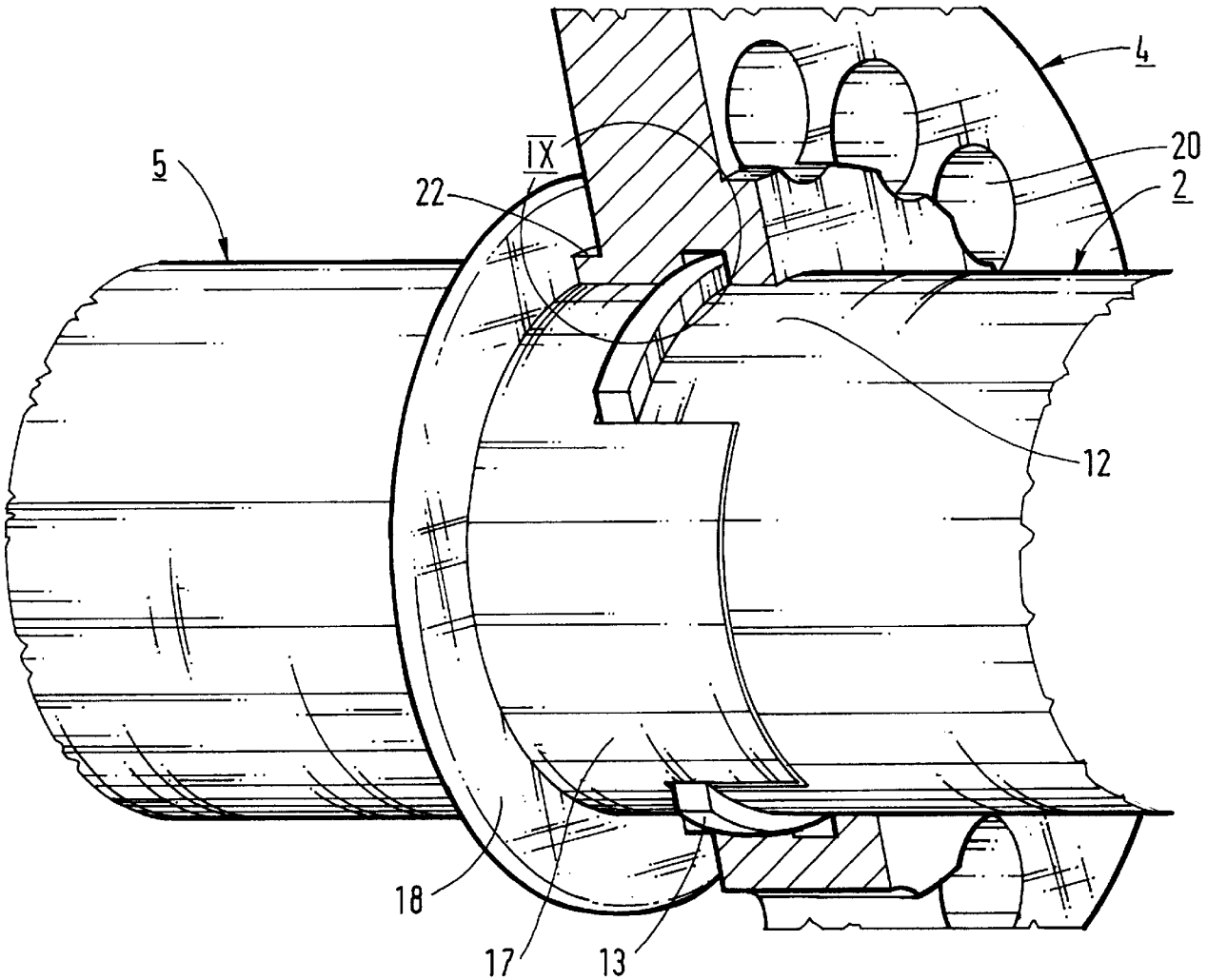
FIG. 8 is a perspective view of the assembly with a portion of the ring being cut away.

The arcing contact support 5 is tubular and, like the drive tube 2, it is provided with n gaps 16 and n claws 17; n being equal to two in the example described and shown in FIGS. 3 and 4. These claws 17 and gaps 16 are complementary to those of the drive tube 2. However, the claws 17 are not provided with rims at their ends. As can be seen in FIG. 8, which shows the parts in the assembled state, the claws 12 and 17 interpenetrate and fill in the gaps, ignoring clearance.

In addition, at a distance $l_l$ from the end walls of the gaps 16, the contact support 5 is provided with a flange 18 of outside diameter $D_1$. On being assembled, as shown in FIG. 8, this flange 18 comes into abutment against a bearing surface 19 (FIG. 5) of the ring 4. This bearing surface 19*a* has an outside diameter $D_2$. Its inside diameter D corresponds to the central bore in the ring 4 ($D_1>D_2>D$).

In this preferred embodiment of the invention, the arcing contact support is fixed rigidly to the ring by means of the tubular portion of length $l_l$ (FIG. 4) of the contact support 5 being forced by means of a press into the bore D of the ring 4 until the flange 18 bears against the bearing surface 19. In contrast, the outside diameter of the claws 17 is such that they penetrate freely into the bore D.

Figure 9:
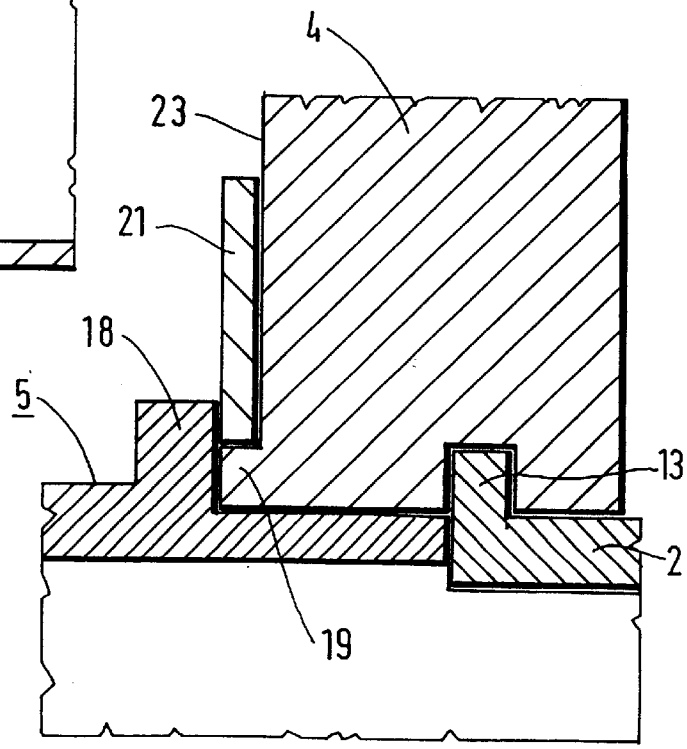
FIG. 9 is a section view of a detail of the portion referenced IX in FIG. 8.

The ring is provided with perforations 20 making it possible, on circuit-breaker opening, for gas to pass through from the compression chamber 6 to the blast chamber 7. As shown in FIG. 9, the ring is equipped with a valve member 21.

The valve member 21 is thus placed in the groove 22 formed by the bearing surface 19 between the flange 18 and the face 23 of the ring 4.

As can be seen, since the groove 22 is formed by the flange 18 bearing against the bearing surface 19, it is possible to place the valve member 21 on the bearing surface 19 (prior to fitting the arcing contact support 5) without having to mount the valve member into the groove by stretching it elastically, thereby making it possible to use a valve member made of metal.

FIG. 9 shows the detail in which the valve 21 can be seen.

Thus, by means of the invention, the tube 2 and the arcing contact 5 are assembled together without being screwed together, thereby avoiding all of the drawbacks mentioned in the introduction.

Fitting the arcing contact support 5 by forcing it into the bore in the ring 4 guarantees excellent electrical contact.

Figure 10:
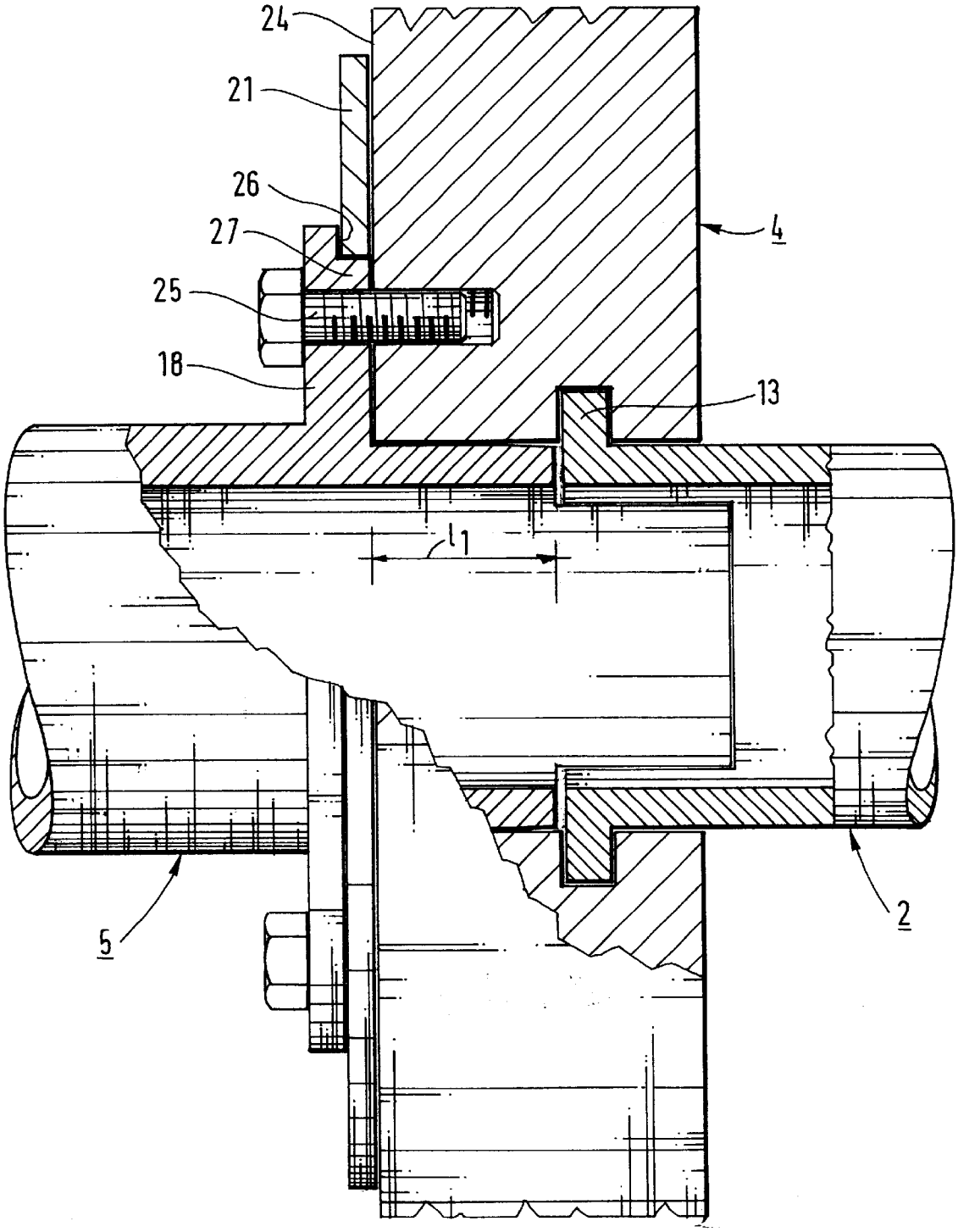
FIG. 10 is a fragmentary view showing a variant relating to how the arcing contact support is fixed to the ring.

FIG. 10 shows a variant embodiment in which instead of being force-fitted, the arcing contact support 5 is fixed via the flange 18 which is used as a fixing flange for fixing against the plane face 24 of the ring 4 by means of fixing screws 25. In which case, the tubular length $l_1$ of the arcing contact support 5 has a diameter D providing a snug fit inside the ring 4. The groove 26 for receiving the valve member 21 is obtained by peripheral machining forming a bearing surface 27 for receiving the valve member 21.

What is claimed is:

1. A circuit-breaker including a moving assembly contained inside a casing filled with a dielectric gas under pressure, the moving assembly including a "drive" first tube, and a second tube surrounding the first tube coaxially, said first and second tubes being connected together via a ring provided with perforations and equipped with a valve member and constituting a moving piston separating a compression chamber from a blast chamber, said first tube being situated on the same side of the ring as the compression chamber and its end connecting to said ring, a moving arcing contact support being situated on the same side of the ring as the blast chamber and being fixed rigidly, with no degrees of freedom, to said ring, wherein, with said ring having a bore of diameter D, said ring is provided with a groove of depth h and of width l at a distance x from its face that faces said compression chamber, that end of said first tube which is connected to said ring being provided with n gaps extending over an axial length L allowing n claws to project, the end of at least one of the claws being provided with a rim that is received in said groove in said ring, said ring being provided with one or more passageways angularly in register with each claw provided with a rim, and making it possible for the rim(s) to be inserted axially as far as said groove, and then for the tube to be turned to cause the rim(s) to penetrate into the groove portions that remain, and wherein said arcing contact support, which is tubular, is provided with n gaps and with n claws that are complementary to the gaps and claws of said first tube, the claws of said arcing contact support fitting into and filing the gaps situated between the claws on said first tube.

2. A circuit-breaker according to claim 1, wherein the end of each claw on said first tube is provided with such a rim.

3. A circuit-breaker according to claim 1, wherein both said tube and said arcing contact support are provided with two claws each.

4. A circuit-breaker according to claim 1, wherein, at a distance $l_1$ from the end-walls of the gaps, said arcing contact support is provided with a flange of outside diameter $D_l$ and that comes into abutment against said ring, means being provided for constituting a groove for receiving a valve member against that face of said ring which faces the blast chamber.

5. A circuit-breaker according to claim 4, wherein said rigid fixing whereby said arcing contact support is fixed rigidly to said ring is achieved by forcing the end of length $l_1$ extending from said flange to the end walls of said gaps to penetrate into the bore of diameter D in said ring, the outside diameter of the claws being such that they penetrate into said bore freely, said means for constituting said groove for receiving a valve member comprising a bearing surface belonging to said ring, of inside diameter D and of outside diameter $D_2$ such that $D_1>D_2>D$, and against which said flange bears.

6. A circuit-breaker according to claim 4, wherein said rigid fixing whereby said arcing contact support is fixed rigidly to said ring is achieved by fixing said flange by means of screws against that face of said ring which faces the blast chamber, the peripheral portion of that side of said flange which bears against said face being provided with a bearing surface for receiving said valve member, and thus forming said groove.

* * * * *